US010798985B2

(12) United States Patent
Manera et al.

(10) Patent No.: US 10,798,985 B2
(45) Date of Patent: Oct. 13, 2020

(54) PROTECTIVE HELMET FOR SPORTING USE, IN PARTICULAR FOR USE WHILE SKIING

(71) Applicant: SAFILO SOCIETÀ AZIONARIA FABBRICA ITALIANA LAVORAZIONE OCCHIALI S.P.A., Padua (IT)

(72) Inventors: Giorgio Manera, Padua (IT); Nicola Belli, Padua (IT)

(73) Assignee: SAFILO SOCIETÁ AZIONARIA FABBRICA ITALIANA LAVORAZIONE OCCHIALI S.P.A., Padua (IT)

( * ) Notice: Subject to any disclaimer, the term of this patent is extended or adjusted under 35 U.S.C. 154(b) by 211 days.

(21) Appl. No.: 15/538,097

(22) PCT Filed: Dec. 14, 2015

(86) PCT No.: PCT/EP2015/079609
§ 371 (c)(1),
(2) Date: Jun. 20, 2017

(87) PCT Pub. No.: WO2016/102225
PCT Pub. Date: Jun. 30, 2016

(65) Prior Publication Data

US 2017/0347741 A1 Dec. 7, 2017

(30) Foreign Application Priority Data

Dec. 23, 2014 (IT) ..... PD2014A0355

(51) Int. Cl.
*A42B 3/12* (2006.01)
*A42B 3/06* (2006.01)

(52) U.S. Cl.
CPC ..... *A42B 3/124* (2013.01); *A42B 3/063* (2013.01); *A42B 3/125* (2013.01)

(58) Field of Classification Search
CPC .. A41D 13/015; A41D 13/0518; A42B 3/063; A42B 3/064; A42B 3/065; A42B 3/124; A42B 3/14
(Continued)

(56) References Cited

U.S. PATENT DOCUMENTS 3,071,216 A * 1/1963 Jones ..... E04C 2/34 105/422
3,231,454 A * 1/1966 Williams ..... B65D 81/03 206/521
(Continued)

FOREIGN PATENT DOCUMENTS

FR 2335168 A1 7/1977

OTHER PUBLICATIONS

Vinyl Nitrile. Dome Materials Website. Retrieved Jun. 16, 2019. http://www.helmetfacts.com/materials/vinyl-nitrile/.*

*Primary Examiner* — Anne M Kozak
(74) *Attorney, Agent, or Firm* — Volpe and Koenig, P.C.

(57) ABSTRACT

There is described a protective helmet for sporting use, in particular for use while skiing, comprising an external cap-like structure (2) of a resiliently flexible material, an internal cap-like structure (3) which is received in the external cap-like structure (2) and which comprises a plurality of cap portions (5*a*, 5*b*) of expanded material which are structurally independent of each other and which are mutually interconnected with limited relative mobility between contiguous portions, the internal cap-like structure (3) delimiting a cavity (4) which is open towards the outer side and which is capable of receiving the head of the user, and at least one device (6) for absorbing energy as a result of forces of impacts on the helmet, which device is inter-
(Continued)

posed between the internal cap-like structure (3) and external cap-like structure (2). The device comprises at least one flexible member (12) which includes a plate-like portion (12*a*) having a transverse thickness (13) which is defined between a pair of opposing surfaces (13*a*, 13*b*) and a plurality of reliefs (14) which project in the same direction from one of the surfaces (13*a*, 13*b*), the reliefs (14) extending with a tapering formation in the direction of the free end (14*a*) thereof, in the direction away from the portion (12*a*), and the at least one member (12) being fixedly joined to the external cap-like structure (12) in the region of the respective free ends (14*a*) of the reliefs (14) and the internal cap-like structure (3) in the region of the surface (13*a*) of the opposite portion (12*a*) to the portion which has the reliefs.

16 Claims, 4 Drawing Sheets

(58) Field of Classification Search
USPC ..... 2/412
See application file for complete search history.

(56) References Cited

U.S. PATENT DOCUMENTS 3,877,076 A * 4/1975 Summers ..... A42B 3/065 2/414
4,023,213 A * 5/1977 Rovani ..... A42B 3/121 2/413
4,432,099 A * 2/1984 Grick ..... A42B 3/124 2/412
4,766,614 A * 8/1988 Cantwell ..... A42B 3/124 2/171.3
4,970,729 A * 11/1990 Shimazaki ..... A42B 3/12 2/181.2
5,030,501 A * 7/1991 Colvin ..... B65D 65/406 428/178
5,319,808 A * 6/1994 Bishop ..... A42B 3/14 2/181.2
5,470,641 A * 11/1995 Shuert ..... B29C 51/10 108/57.27
5,518,802 A * 5/1996 Colvin ..... B32B 3/12 428/166
5,950,243 A * 9/1999 Winters ..... A42B 3/065 2/411
6,752,450 B2 * 6/2004 Carroll, III ..... B32B 3/28 188/371
6,969,548 B1 * 11/2005 Goldfine ..... B29C 44/1214 428/159
D521,191 S * 5/2006 Berger ..... D29/122
7,360,822 B2 * 4/2008 Carroll, III ..... B60N 2/4249 296/187.03
7,404,593 B2 * 7/2008 Cormier ..... A62B 1/22 296/187.03
7,625,023 B2 * 12/2009 Audi ..... A62B 1/22 293/134
7,673,351 B2 * 3/2010 Copeland ..... A42B 3/124 2/425
7,802,320 B2 * 9/2010 Morgan ..... A42B 3/128 2/411
D655,051 S * 2/2012 O'Keefe ..... D29/122
8,544,117 B2 * 10/2013 Erb ..... A42B 3/122 2/410
9,320,311 B2 * 4/2016 Szalkowski ..... A42B 3/12
9,394,702 B2 * 7/2016 Cormier ..... B29C 45/14
9,474,318 B2 * 10/2016 Wesson ..... A42B 3/128
9,516,910 B2 * 12/2016 Szalkowski ..... F41H 1/08
2002/0017805 A1 * 2/2002 Carroll, III ..... A62B 1/22 296/187.03
2005/0196592 A1 * 9/2005 Tao ..... A42B 3/124 428/180
2005/0200062 A1 * 9/2005 Maurer ..... F16F 7/08 267/144
2005/0246824 A1 * 11/2005 Berger ..... A42B 3/124 2/412
2006/0070170 A1 * 4/2006 Copeland ..... A42B 3/124 2/411
2007/0209098 A1 * 9/2007 Peart ..... A42B 3/124 2/410
2007/0226881 A1 * 10/2007 Reinhard ..... A42B 3/065 2/412
2009/0106882 A1 * 4/2009 Nimmons ..... A42B 3/20 2/414
2009/0222975 A1 * 9/2009 Green ..... A42B 1/08 2/410
2010/0000009 A1 * 1/2010 Morgan ..... A42B 3/124 2/414
2010/0186150 A1 * 7/2010 Ferrara ..... A42B 3/128 2/412
2010/0258988 A1 * 10/2010 Darnell ..... A42B 3/064 267/141
2010/0299812 A1 * 12/2010 Maddux ..... A41D 13/0156 2/414
2011/0131695 A1 * 6/2011 Maddux ..... A42B 3/18 2/9
2011/0296594 A1 * 12/2011 Thomas ..... A42B 3/124 2/414
2012/0036620 A1 * 2/2012 Harris ..... A42B 3/127 2/414
2013/0152287 A1 * 6/2013 Cormier ..... A42B 3/124 2/459
2013/0185837 A1 * 7/2013 Phipps ..... A42B 3/12 2/2.5
2013/0333100 A1 * 12/2013 Erb ..... A42B 3/124 2/425
2013/0340146 A1 * 12/2013 Dekker ..... A42B 3/125 2/411
2014/0013492 A1 * 1/2014 Bottlang ..... A42B 3/125 2/414
2014/0109299 A1 * 4/2014 Kwan ..... A41D 13/015 2/413
2015/0047113 A1 * 2/2015 Stringfellow ..... A42B 3/124 2/455
2015/0223547 A1 * 8/2015 Wibby ..... A42B 3/125 2/414
2016/0000167 A1 * 1/2016 Alley ..... A42B 3/22 2/412
2016/0206034 A1 * 7/2016 Degolier ..... A42B 3/127
2016/0316847 A1 * 11/2016 Weber ..... A42B 3/125
2017/0188648 A1 * 7/2017 Larrabee ..... A42B 3/28

* cited by examiner

PROTECTIVE HELMET FOR SPORTING USE, IN PARTICULAR FOR USE WHILE SKIING

TECHNICAL FIELD

The present invention relates to a protective helmet for sporting use, in particular for use while skiing, having the features set out in the preamble of the main claim 1.

TECHNOLOGICAL BACKGROUND

In the specific technical field of protective helmets for sporting use, and in particular for use while skiing, there is a need to construct helmet structures which are suitable for ensuring, besides comfort and adaptability of fitting, a high capacity for absorption of the energy resulting from an impact generated by the forces of a collision.

In general, an adequate rigidity of the cap, which is suitable for counteracting and distributing the stresses of the collision, has to be provided with appropriate deformability of the structure suitable for maximising the absorption of energy of a collision. On the basis of those prerogatives, conventional protective helmet structures constitute an adequate compromise between the various requirements set out.

There are further known protective helmet structures in which there is produced an external cap-like structure which is separate from an internal cap-like structure and in which there are provided one or more layers of suitable material which are interposed between the two cap-like structures indicated, which is/are required to absorb the impact energy by means of suitable deformation.

STATEMENT OF INVENTION

An object of the invention is to provide a protective helmet which is suitable for improving the helmets structures of the known solutions, and which is in particular structurally and functionally configured to ensure a high level of adaptability of fitting and improving at the same time the protective capacity, resulting in a high capacity for absorption of the collision forces, not only when those forces are directed to be substantially perpendicular to the surfaces of the helmet but also when the collision force has a component in the direction tangential to the surface of the helmet, in the region of the contact location with the obstacle or the impact surface.

This object and other objects are achieved by the invention by means of a protective helmet for sporting use, constructed in accordance with the appended claims.

BRIEF DESCRIPTION OF THE DRAWINGS

Other features and advantages of the invention will be better appreciated from the following detailed description of a preferred embodiment thereof which is illustrated by way of non-limiting example with reference to the appended drawings in which.

PREFERRED EMBODIMENTS OF THE INVENTION

Figure 1:
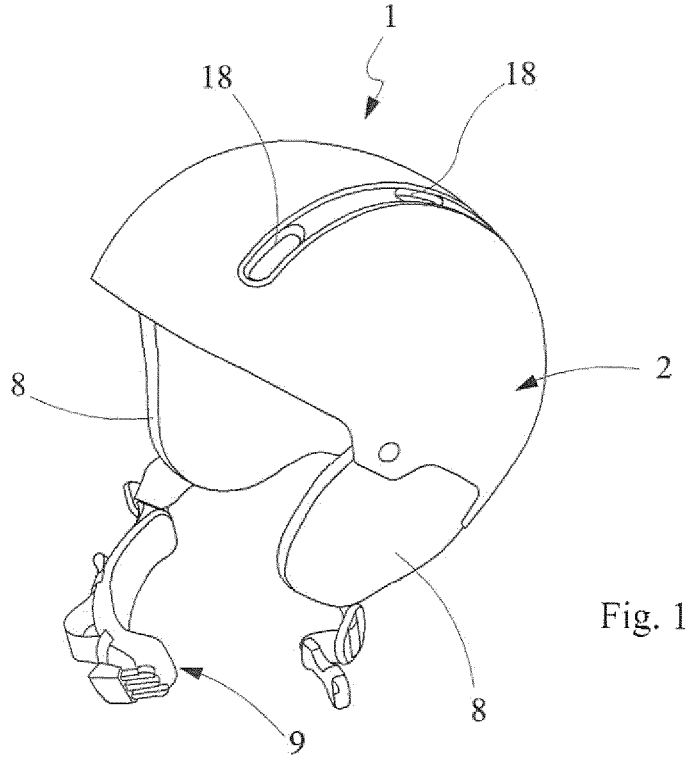
FIG. 1 is a perspective view of a helmet constructed according to the invention.
Figure 2:
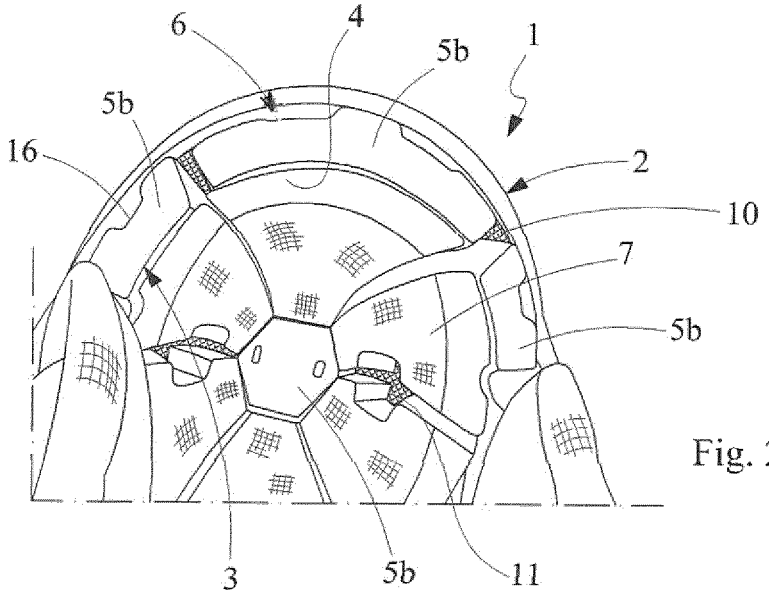
FIG. 2 is another partial perspective view of the helmet of FIG. 1, FIGS. 3 and 4 are perspective views of a first detail of the helmet of the preceding Figures.
Figure 5:
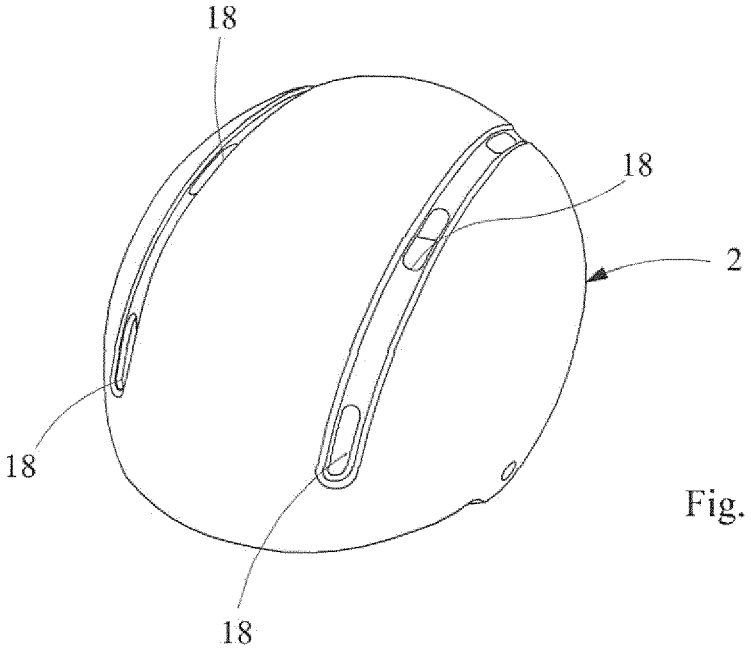
FIG. 5 is a perspective view of a second detail of the helmet of the preceding Figures.

With reference to the cited Figures, there is generally designated 1 a protective helmet for sporting use, in particular for use while skiing, which is produced in accordance with the present invention.

The helmet comprises an external cap-like structure 2 and an internal cap-like structure 3, the internal structure being inserted in the external structure and being capable of delimiting a cavity 4 which is open towards the outer side in order to receive the head of the user.

The internal cap 3 comprises a plurality of portions 5*a*, 5*b* which are preferably of an expanded material and which are constructed to be structurally independent of each other and which are mutually interconnected with limited relative mobility between contiguous portions, as will be set out more clearly below. The internal cap-like structure is therefore configured to be received in the cavity of the external cap and to be secured thereto.

There is interposed between the external cap-like structure and internal cap-like structure a device for absorbing energy as a result of forces of impacts on the helmet, which device is generally designated 6. The helmet further comprises one or more internal padding elements which are designated 7 and which are conventional per se and intended to be applied to the internal surface of the internal cap-like structure 3, which is directed into the cavity 4, so as to be in direct contact with the head of the user with the helmet on.

There are designated 8 ear protection structures which extend below so as to extend the cap-like structures 2, 3, while a system of straps for retaining the helmet on the head of the user is generally designated 9, the system including suitable means for adjusting the straps.

Figure 4:
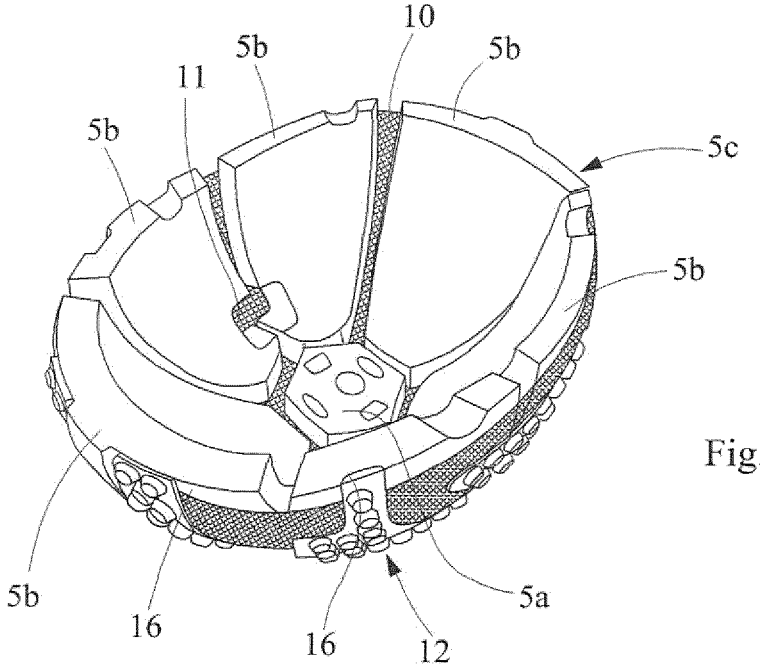
Figure 9:
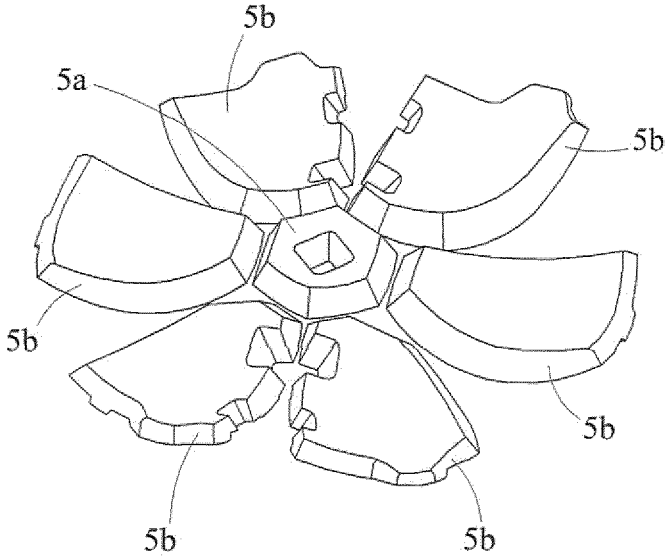
FIG. 9 is a perspective view of another detail of the helmet according to the invention in a construction step thereof.
Figure 6:
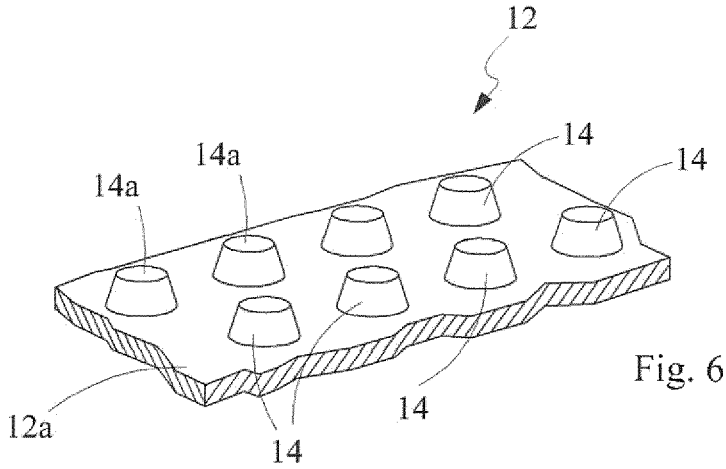
FIG. 6 is a schematic cross-section, drawn to an enlarged scale, of a specific detail of the detail of FIGS. 3 and 4, FIGS. 7 and 8 are longitudinal sections of the detail of FIG. 6.
Figure 7:
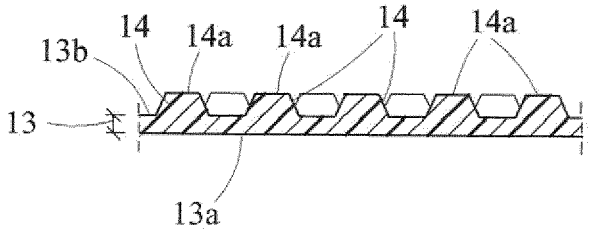
Figure 8:
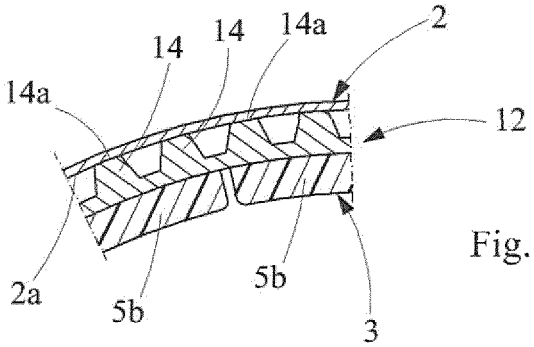

FIG. 4 shows the internal cap-like structure which is defined by the portions 5*a*, 5*b* of expanded material. Those portions are produced in the manner of plates having such a form as to define, when they are arranged one contiguous to the other, the overall formation of the internal cap.

A preferred configuration provides, in the cap-like structure 3 assembled, for a first central cap portion or plate 5*a* which is arranged in an upper position and a plurality of cap portions or plates 5*b* which extend in a crown-like manner around the first portion in order to extend therefrom as far as a lower edge 5*c* of the helmet.

The internal cap portions are interconnected and retained relative to each other by means of a fabric structure 10 which extends and is secured to the upper convex surfaces of the internal cap portions. The fabric structure 10 can be formed by a plurality of fabric portions which cover the internal cap and follow the general convex form of the cap itself, in order to maintain the cap portions or plates in the preselected configuration. Preferably, the fabric structure is perforated and there is advantageously selected, for example, a web-like fabric.

The internal cap portions are interconnected by the web-like fabric in a configuration in which the portions are contiguous and in a mutually spaced-apart relationship. Therefore, there is provision for empty spaces to remain defined between each pair of mutually contiguous plates 5*b* of the crown and between each of the plates 5*b* of the crown and the central/upper plate 5*a*. In other words, the respective edges or rims of the plates 5*a*, 5*b* are not in contact with each other. The object of this configuration is to allow where necessary a given relative mobility of each portion or plate with respect to those adjacent, in particular under two specific conditions. A first condition relates to the fitting of the helmet, in which the relative mobility of the plates allows the helmet to be self-adjusting within specific limits relative to the head of the user, allowing increased fitting comfort. The second condition is the one in which a potential collision is identified, for example, during a fall or during impact against an obstacle. In this case, the deformation of the internal cap-like structure contributes to absorbing the impact, reducing the effects on the structure of the helmet and therefore the head of the user.

The spacing which separates the edge of each plate 5*a*, 5*b* from the perimeter edge of the adjacent plates is selected so as to allow a good range of relative movement between the plates. Preferably, there is provision for each plate no longer to have contact with one or more adjacent plates, even in the case of great deformation. Therefore, it involves a spacing provided between plates in the order of a few millimetres.

The web-like fabric may be, for example, applied to the portions or plates 5*a*, 5*b* by means of a co-injection-moulding process. It is possible, for example, for there to be provided a mould for forming the plates of expanded material (for example, of polystyrene or polypropylene), inside which there is positioned the web (or the portions of the web), before the injection of the material. By the injection and expansion of the material of the plates then being carried out, the fixed joining between the web and plates is obtained. Alternatively, it is possible to carry out the forming of the various portions or plates of the internal cap, including separately from each other, and to subsequently join the web or the web portions with the various plates, by means of an adhesive bonding with a suitable adhesive.

The web-like fabric structure 10 has a suitable flexibility in order to be capable of being adapted to the curves of the mould of the portions of internal cap, as well as to allow any relative movements of the plates. It is therefore provided to be flexible and easy to bend, in addition to being resistant to ripping.

The web-like structure, which is distinguished by a network of through-holes, in addition to making the fabric suitably deformable, has the advantage of making the ventilation of the helmet easier. The internal cap-like structure in fact allows adequate ventilation of the interior of the helmet by means of the empty spaces provided between the various portions or plates 5*a*, 5*b*. The air internal with respect to the helmet can in fact find an outlet through those openings, in the region of which there are located portions of web which, as described, have a "perforated" structure, and therefore allow the passage of air. In addition, there may be provided additional through-openings 11 through the various plates, for the purpose of increasing the rate of flow of air. Again with regard to the device 6 for absorbing impact energy, it comprises one or more resiliently flexible members 12, each of which includes a plate-like portion 12*a* having a transverse thickness 13 which is defined between a pair of opposing surfaces 13*a*, 13*b*. Each member 12 further comprises a plurality of reliefs 14 which project upwards in the same direction from the surface 13*b* of the portion 12*a*, which have a tapering formation in the direction of the respective free end 14*a*, in the direction away from the portion 12*a*.

On the member 12, the reliefs 14 are preferably provided with an identical formation, with a geometrically regular and repetitive form. A preferred selection provides for the reliefs to have a frustoconical formation.

Each member 12, in which the portion 12*a* and the reliefs 14 are advantageously formed in one piece, is constructed from a material which is characterized by a high capacity for absorption of impacts, that is to say, damping of the acceleration at the time of impact.

Preferably, the material mentioned above is flexible in a resilient or viscoelastic manner, or in any case readily deformable, so that it is possible to produce members 12 initially with a substantially planar extent. It is thereby possible to apply them to the convex upper surfaces of the internal cap 3, using the resilience of the material, and causing the members 12 to follow the curvature of the portions or plates 5*a*, 5*b*, while being adapted thereto at each location.

The surface 13*a*, which is preferably smooth, is intended to be positioned in contact with the external surfaces of the internal cap portions. During application of the member 12, there is provision for the frustoconical reliefs 14 to be positioned with the upper free ends 14*a* thereof directed towards the internal surface 2*a* of the external cap 2, and in direct contact therewith.

Each member 12 of the device 6 is advantageously fixedly joined to the external cap-like structure 2 in the region of the free ends 14*a* of the reliefs 14 and with the internal cap-like structure 3 in the region of the surface 13*a*.

The function of the reliefs 14 is to absorb the impact energy during any impact, being effective in three different possible conditions, in a first condition with impact force directed precisely along the perpendicular relative to the surface of the helmet, that is to say, ideally directed towards the centre of gravity of the head of the user, in a second condition with an impact force which is "tangential", that is to say, with an impact force having a direction tangent or "sliding" relative to the same surface, and in a third condition with an impact force resulting from the combination of the two preceding conditions.

In other words, the force in the third condition is applied with a given angulation with respect to the perpendicular to the surface of the helmet.

In the first condition, the reliefs 14 deploy their impact absorption capacity by means of a simple deformation along the axis of longitudinal extent thereof, therefore being subjected to compression stress.

In the second condition, the reliefs 14 deploy their impact absorption capacity by means of a deformation in a transverse direction relative to the longitudinal axis thereof (for example, by means of flexion). In this case, in fact, the impact force brings about an urging or cutting force on the relief. In this condition, it should be noted how, as a result of the frustoconical form, each relief 14 is capable of becoming deformed in any transverse direction with respect to the individual axis thereof.

With regard to the third condition, it is considered that with each relief 14 being able to be deformed at the same time in the transverse direction and in the longitudinal direction, it is capable of being effective during absorption of the impact, even in the case of forces with a component perpendicular to the helmet, and a component in the transverse direction in any direction.

In a definitive manner, each relief 14 is effective in the absorption of the impact within a range of directions equal to 360° in the plane tangent to the surface of the helmet at any location of impact with respect to the helmet, and 180° in any plane which extends through the perpendicular at that location. As a result of the provision of the device 6, the helmet is capable of providing not only a great reduction of the translational acceleration, which can be measured at the centre of gravity of the head of the user, but also a great reduction of the rotational acceleration brought about in the head, in the event of impact with forces having a component which is also tangential.

With regard to the materials which can be used for constructing the member 12, an example is constituted by microcellular expanded materials or microcellular foams, preferably of the open-celled type, which are more or less flexible or resilient, and which are also available in versions which are suitably formulated to be particularly effective for the absorption of the impacts.

Another example is constituted by so-called expanded rubbers, also referred to as "foam rubbers", which are also available in versions which are suitably formulated to be particularly effective for the absorption of the impacts. The expanded rubbers are also substantially constituted by "cellular" or "porous" materials but more often have cells of the closed type.

In particular, expanded microcellular materials based on polyurethane are very suitable for the purpose. However, a type of expanded rubbers which can be used in an effective manner is the type of the expanded nitrile rubbers, for example, so-called vinyl/nitrile foams.

Another example of a material which can be used is that of foams based on EVA (ethylene vinyl acetate polymer).

With regard to the technological processes for producing the members 12 for absorption of the impact energy, they depend on the type of material preselected. For example, in the case of an expanded polyurethane material, it is possible to produce the members 12 by means of an injection/expansion process inside suitable moulds.

In the case of a vinyl-nitrile foam, however, it is possible to obtain the members 12 by means of a hot moulding process (forming with compression), which is carried out on semi-finished components having a simpler form (planar pieces with a constant thickness), obtained beforehand with an injection/expansion process in a suitable mould. It is also possible in the case of the EVA-based foams to use a hot moulding process which is carried out on planar semi-finished components which are previously moulded with the injection/expansion process.

It may be noted that many, if not the majority, of the materials characterized by good or optimum capacity of impact reduction, from the mechanical point of view, have so-called viscoelastic material properties to a greater or lesser extent. Other materials are characterized by having substantially resilient properties. Other types of materials have a combination of resilient and viscoelastic properties, with one or other being prevalent on the basis of the formulation or composition of the material.

Even if the device described here may also be constructed from resilient material, it is preferable to use materials of the viscoelastic or at least partially viscoelastic type given that potentially those two second types of material provide a greater capacity for absorption of the impact, understood to be a reduction of the acceleration peak at the time of impact, with respect to completely resilient materials.

Preferably, the elements 12 are produced in the form of planar members which are then adapted to the curved surfaces by the internal cap of the helmet, as a result of the ease of bending thereof.

The elements 12 are fixed to the portions or plates of the internal cap 3, preferably by means of adhesive bonding.

It is possible for a single member 12 of the device 6 to extend so as to partially cover two or more internal cap portions which are contiguous to each other, or alternatively there is provision for a single member 12 to be applied to a single portion.

Particularly if there are provided one or more members 12 which each extend in a plurality of contiguous internal cap portions, it is possible for ease of construction to choose to fix the member 12 above the web-like structure which covers the cap portions. In this case, the adhesive is applied directly to the web, through the holes or openings of which it tends to flow in any case, reaching the free portions of the external surface of the internal cap portion, that is to say, the portions placed in the region of the openings of the web itself.

In that manner, the bonding will involve at the same time the cap portion, the web-like structure and the impact absorption member 12, serving to locally join together the three separate components.

There is also provision for one or more of the members 12 to be provided with one or more through-openings 15 for the ventilation of the helmet. In that case, the openings 15 are located in the region of the same number of through-openings 11 which are formed in the plates of the internal cap, with the web-like fabric 10 as the single member for covering the openings. It may be noted how the web-like configuration is suitable for the passage of air, and therefore for perspiration during use of the helmet.

If a member 12 of the impact absorption device extends over a plurality of internal cap portions, it still allows a freedom of movement of each portion with respect to the contiguous portion, as a result of the deformability of the material from which the member 12 is formed.

Preferably, the upper convex surfaces of the portions or plates of the internal cap 3 have some zones 16 having a reduced thickness, with contours which are substantially equal to those of corresponding elements 12. Those zones constitute seats for receiving and applying the same members 12. The depth of the seats 16 is in any case selected to be less than the total height or thickness of the members 12, in such a manner that the frustoconical reliefs 14 project above the seats 16 in any case.

Figure 3:
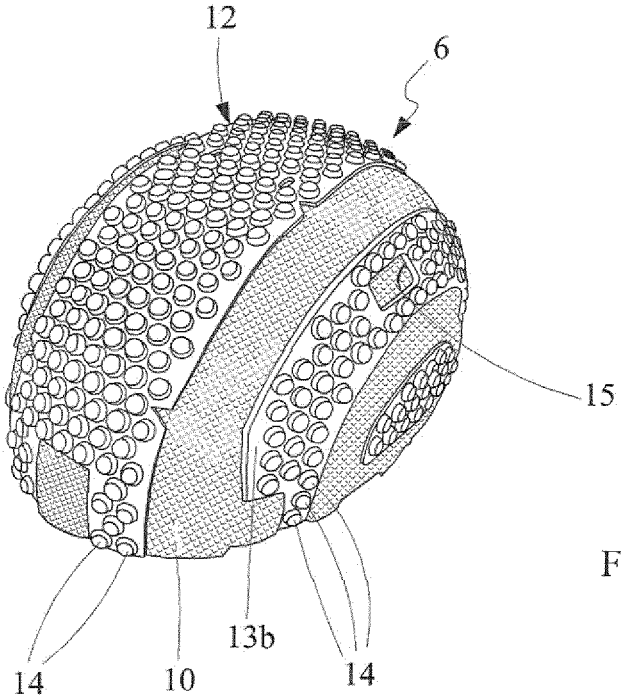

The plurality of reliefs 14 of each member 12 can be advantageously produced in an orderly manner, for example, by providing a configuration with a succession of rows of reliefs which are parallel and spaced apart in a preselected direction, and in which the reliefs of each row are mutually spaced apart with regular pitch. It is further possible to provide for the reliefs of a row to be offset with respect to the reliefs of an adjacent row, in the transverse direction relative to the extent of the rows (FIG. 3), that configuration generating a tissue of cross-like channels (defined between the spaces produced between the rows of reliefs), which facilitate general ventilation of the helmet.

Again with reference to the external cap-like structure 2, it contributes in a manner conventional per se to the at least partial absorption of the impact at the time of impact and further ensures protection from sharpened objects and from abrasion in the event of sliding over roughened surfaces.

According to the invention the external cap-like structure has a given degree of flexibility or resilient deformability, so as to allow the mobility of the portions or plates of the internal cap 3.

The external cap 2 can advantageously be produced from a plastics material ABS, which is obtained with a thickness so as to be sufficiently resilient.

It may be noted how the impact absorption members 12 constitute a type of spacer for the external cap, with respect to the internal cap. Preferably, there is provision for the whole of the elements 12 not to cover the whole of the total external surface of the internal cap 3. In that manner, there are produced channels or corridors, that is to say, empty spaces which are interposed between the external cap and the internal cap, which are confined at the perimeter between the various member portions 12.

Those corridors are in communication with the spaces which separate the various internal cap portions or plates 3 and optionally also with the openings 11 which are formed in the internal cap. The corridors therefore act as channels for the flow of air necessary for the ventilation of the helmet, which flow is particularly effective when the user is moving.

In that condition, the air which is introduced into the front zone of the helmet, through suitable front openings which communicate with the above-mentioned internal corridors, flows in the front/back direction in the intermediate space between the caps 2, 3, in order then to be discharged from the helmet through openings which are formed in the rear zone. The front openings and the rear openings can be constituted simply by spaces between the internal cap and external cap, which are open at the front edge and at the rear edge of the helmet, respectively.

During flow in the front/back direction, the air being drawn in tends to engulf the air which is located in the openings of the internal cap (formed both as through-openings over the thickness and as spaces between one plate and another), that is to say, the air which is located near the head of the user, and which will therefore contain the product of any perspiration.

The volumes of air extracted from the openings of the internal cap are also discharged through the openings of the helmet formed in the rear zone.

There is therefore obtained a continuous exchange of air, by means of extraction of the air containing the perspiration of the head, and the replacement with new "fresh" air. The external cap 2 may also have some through-openings 18, still for the purpose of ventilation. Those openings 18 may be located in the region of the openings provided in the internal cap or may simply be located in the region of the corridors formed in the intermediate space between the two caps.

With regard to the assembly of the external cap 2 on the remainder of the structure of the helmet, there is provision for the fixing of the internal surface 2*a* of the external cap to the upper free ends 14*a* of the reliefs 14 of the corresponding member 12. In particular, there is provision for the fixing between the external cap 2 and members 12 by means of adhesive bonding with an adhesive applied between the surfaces of the upper ends 14*a* of the reliefs 14, and corresponding zones of the surface 2*a* of the external cap 2. In fact, with the external cap 2 being fixedly joined to the ends 14*a* of the reliefs 14, in the event of an impact force with a sliding component, the external cap 2 is what transmits the transverse stress to the reliefs 14, causing it to become deformed (also) in a transverse manner and, therefore, to carry out its own function of absorption of the energy of the impact forces.

The invention thereby achieves the objects set out and affords the advantages set out with respect to the known solutions.

In particular, with the invention there are advantageously obtained, and in combination with each other, a high level of adaptability of fitting and a high level of capacity of absorption of impact forces, including in the case of impact force with a component in the direction tangent to the surface of the helmet.

The above-mentioned prerogatives are further obtained in the helmet according to the invention without involving an increase in the total thickness of the helmet, and therefore without an increase in the external volume thereof.

As a result of the high capacity of absorption of the impact provided by the impact absorption device according to the invention, it is in fact possible to use an internal cap of expanded material which is characterized by a lower thickness with respect to the thickness of the internal cap which is typical of conventional helmets.

This is a result of the fact that the contribution to the impact absorption which can be assigned to the device interposed between the caps in fact compensates for the reduction of the contribution to the absorption corresponding to the reduction of thickness of the cap of expanded material.

Another advantage is connected with the fact that, as a result of the tapered formation (in particular frustoconical) of the reliefs which form the impact absorption device, there is a reduction in the total surface involved in the securing action (bonding) of the reliefs with respect to the external cap, reducing at the same time the effect of imprecision during connection between the upper end of each relief and the corresponding surface portion of the external cap on which it has to be secured.

In fact, it is considered that, in the hypothesis of constructing reliefs with a cylindrical form, that is to say, with a constant diameter, in the adhesion zones between the upper end of the single relief and the corresponding external cap portion, there would be contact between a planar surface (the surface of the relief) and a curved surface (the cap portion). The connection between the two surfaces would not therefore be at an optimum, with non-ideal conditions of bonding and consequently a risk of great limitations with respect to the durability or efficiency of the bonding itself.

A possible solution would be the construction of reliefs with ends which are dome-like or rounded or in any case characterized by a curved surface, so as to be adapted to the curvature of the surface of the external cap.

However, it is necessary to consider that typically the external cap and also the internal cap of a protective helmet do not have a curvature which is equal at every location, having to be adapted to the head of a human being, which by its nature has different curvatures in the region of different respective zones.

Consequently, in that hypothesis it would be necessary to form each single relief so that the end thereof has the same curvature as the corresponding cap portion, that is to say, it would be necessary to differentiate the forms of the ends of the various reliefs. However, this would be a complex operation and therefore expensive, given that in the helmet there could be found a considerable number of portions characterized by curvatures which are also substantially different from each other.

Instead selecting a single tapered form for each relief, it is possible for the free end of each single relief to have a reduced diameter and therefore a final surface which is contained, although it is still planar. There corresponds to a planar surface of reduced area a reduction of the importance of the imprecision of the connection thereof to the curved surface of the corresponding portion of surface of the external cap.

All the reliefs being provided with a single tapered form, it is therefore possible to simplify the production process of the members of the device 6, thereby maintaining it at a technically and economically comparable level, further obtaining minimising of the imprecision of connection during contact between each relief and the corresponding external cap portion and therefore the imprecision of the relevant bonding.

The invention claimed is:

1. A protective helmet for sporting use comprising:

an external cap (2) of a resiliently flexible material, an internal cap (3) which is received in the external cap and which comprises a plurality of cap portions (5*a*, 5*b*) of expanded material which includes sections that are interconnected such by a fabric structure that each section allows for some degree of independent movement, the internal cap (3) delimiting a cavity (4) and which is capable of receiving the head of the user, at least one device (6) for absorbing energy as a result of forces of impacts on the helmet, which device is interposed between the internal cap (3) and external cap (2), wherein the at least one device (6) comprises at least one flexible member (12) which includes a base portion (12*a*) having a transverse thickness (13) which is defined between a pair of opposing surfaces (13*a*, 13*b*) and a plurality of reliefs (14) which project in the same direction from one of the surfaces (13*a*, 13*b*), the reliefs (14) extend with a tapering formation in a direction of a free end (14*a*) thereof, in the direction away from the base portion (12*a*), the at least one member (12) is fixedly joined to the external cap (2) in the region of the respective free ends (14*a*) of the reliefs (14) with the external cap (2) being fixedly joined to the ends (14*a*) of the reliefs (14) and the at least one member (12) is fixedly joined to the internal cap (3) in the region of the surface (13*a*) of the opposite base portion (12*a*) to the portion which has the reliefs (14), wherein the respective free ends (14*a*) of the reliefs (14) are secured to a surface (2*a*) of the external cap (2) facing it, by means of adhesive bonding and the base portion (12*a*) of the at least one flexible member (12) is secured to the internal cap (3) by means of adhesive bonding.

2. The helmet according to claim 1, wherein the reliefs (14) are solid and have a frustoconical formation.

3. The helmet according to claim 1, wherein the plurality of reliefs (14) are arranged on the at least one member (12) with rows of reliefs (14) which are spaced apart from each other in a direction, and wherein the reliefs (14) of each row are mutually spaced apart with regular pitch.

4. The helmet according to claim 3, wherein the reliefs (14) of a row are staggered with respect to the reliefs (14) of an adjacent row.

5. The helmet according to claim 1, wherein the at least one flexible member (12) is produced from an expanded rubber.

6. The helmet according to claim 5, wherein the material of the at least one flexible member (12) is an expanded rubber based on polyurethane, or nitrile or based on EVA (ethylene vinyl acetate polymer).

7. The helmet according to claim 1, wherein the member (12) is produced from an open celled microcellular expanded material.

8. The helmet according to claim 7, wherein the microcellular expanded material is based on polyurethane.

9. The helmet according to claim 1, wherein the at least one flexible member (12) is produced with injection processes, an expansion process or both an injection and an expansion process inside molds or with hot molding processes.

10. The helmet according to claim 1, wherein the plurality of cap portions (5*a*, 5*b*) are retained relative to each other by the fabric structure (10) in a mutually spaced-apart position in order to enclose a user's head with limited relative mobility.

11. The helmet according to claim 10, wherein the fabric structure (10) comprises a fabric that allows passage of air.

12. The helmet according to claim 11, wherein the fabric that allows passage of air is positioned on respective surfaces of the plurality of cap portions (5*a*, 5*b*) which are directed towards the external cap (2) and is secured to the surfaces so as to maintain each cap portion at a distance from a contiguous cap portion of the plurality of cap.

13. The helmet according to claim 12, wherein the fabric that allows passage of air is secured to the plurality cap portions (5*a*, 5*b*) by means of a co-injection-molding process.

14. The helmet according to claim 12, comprising, on the surfaces of the plurality of cap portions which are directed towards the external cap (2), recessed portions which define seats (16) for at least partially receiving the base portion (12*a*) of the at least one flexible member (12) of the at least one device (6) for absorbing impact energy.

15. The helmet according to claim 1, wherein the plurality of cap portions (5*a*, 5*b*) comprises a first upper central cap portion (5*a*) and surrounding cap portions (5*b*) which extend around the first central cap portion (5*a*) as far as a location at a lower edge (5*c*) of the helmet.

16. The helmet according to claim 1, wherein the at least one flexible member (12) is resilient.

* * * * *